US011782381B2

(12) United States Patent
Sato

(10) Patent No.: US 11,782,381 B2
(45) Date of Patent: Oct. 10, 2023

(54) IMAGE FORMATION DEVICE

(71) Applicant: KYOCERA Document Solutions Inc., Osaka (JP)

(72) Inventor: Takehiro Sato, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/926,236

(22) PCT Filed: May 13, 2021

(86) PCT No.: PCT/JP2021/018218
§ 371 (c)(1),
(2) Date: Nov. 18, 2022

(87) PCT Pub. No.: WO2021/235315
PCT Pub. Date: Nov. 25, 2021

(65) Prior Publication Data

US 2023/0195028 A1 Jun. 22, 2023

(30) Foreign Application Priority Data

May 20, 2020 (JP) ..... 2020-088324

(51) Int. Cl.
*G03G 21/16* (2006.01)
*G03G 15/20* (2006.01)
*G03G 21/18* (2006.01)

(52) U.S. Cl.
CPC ..... *G03G 21/1647* (2013.01); *G03G 15/2017* (2013.01); *G03G 15/2064* (2013.01);
(Continued)

(58) Field of Classification Search
CPC ..... G03G 21/1647; G03G 15/2017; G03G 15/2064; G03G 21/1864;
(Continued)

(56) References Cited

U.S. PATENT DOCUMENTS

2009/0060571 A1* 3/2009 Kang ..... G03G 21/1685 399/328
2009/0245865 A1* 10/2009 Shinshi ..... G03G 15/2064 399/122

(Continued)

FOREIGN PATENT DOCUMENTS

JP 2013-072987 4/2013

*Primary Examiner* — Sandra Brase
(74) *Attorney, Agent, or Firm* — LEX IP MEISTER, PLLC

(57) ABSTRACT

In an image formation device, a driven gear is coupled to a far end portion in a unit inserting and withdrawing direction of a rotary fixing member or a rotary pressure member of a fixing unit. A driving gear is provided in a far end portion of a fixing unit housing part and engages with the driven gear when the fixing unit is housed in the fixing unit housing part. The driving gear and the driven gear are formed so that a transmission force transmitted from the driving gear to the driven gear in a mutual engagement position has a component so directed as to horizontally press the fixing unit against columns making a pair. The fixing unit as housed in the fixing unit housing part is pressed by the transmission force against the columns and positioned in a direction orthogonal to the unit inserting and withdrawing direction.

7 Claims, 14 Drawing Sheets

(52) U.S. Cl.
CPC ..... *G03G 21/1864* (2013.01); *G03G 21/1619* (2013.01); *G03G 2221/1639* (2013.01); *G03G 2221/1657* (2013.01)

(58) Field of Classification Search
CPC ... G03G 2221/1639; G03G 2221/1657; G03G 21/1685; G03G 21/1619
See application file for complete search history.

(56) References Cited

U.S. PATENT DOCUMENTS

| | | | | |
|---|---|---|---|---|
| 2009/0263155 | A1* | 10/2009 | Murano | G03G 15/2064 399/107 |
| 2015/0071680 | A1* | 3/2015 | Fukuda | G03G 21/1647 399/122 |
| 2018/0032028 | A1* | 2/2018 | Watatani | G03G 21/1647 |

* cited by examiner

IMAGE FORMATION DEVICE

TECHNICAL FIELD

The present invention relates to an image formation device.

BACKGROUND ART

An electrophotographic image formation device generally includes a fixing unit to fix a toner image to a sheet with a fixing roller and a pressure roller that are brought into pressure contact with each other and as such rotated. In such fixing unit, the toner image on the sheet is heated and put under pressure when the sheet passes through a nipping part formed between the fixing roller and the pressure roller, so as to fix the toner image to the sheet.

The fixing unit normally includes a housing that the fixing roller and the pressure roller are housed in. The housing is detachably attached to an image formation device body. Patent Literature 1 discloses an exemplary structure allowing the fixing unit to be attached to and detached from the image formation device body.

In an image formation device in the patent literature, an attaching and detaching direction of the fixing unit is set as a direction orthogonal to a longitudinal direction of the housing (an axial direction of the fixing roller). On either side face in a longitudinal direction of the housing, an engagement pin is protrusively provided. The image formation device body is provided with a pressing member that engages with the respective engagement pins and presses the fixing unit in an attaching direction against the image formation device body with a biasing force of a biasing member when the fixing unit is attached to the image formation device body. The pressing member is arranged pivotably on a specified axis, and the engagement between the pressing member and the engagement pins is released by operating an operation lever.

CITATION LIST

Patent Literature

PTL1: JP 2013-072987 A

SUMMARY OF THE INVENTION

Problems to be Solved by the Invention

As seen from Patent Literature 1, in a conventional positioning structure where the engagement pin provided on the fixing unit is to be engaged with an engagement groove provided on the image formation device body, the engagement groove needs to be made large in diameter as compared with the engagement pin in order to ensure attachability and detachability of the fixing unit. A problem, however, arises in that accuracy in positioning the fixing unit deteriorates if the engagement groove is made large in diameter as compared with the engagement pin.

For the conventional positioning structure as above, it is necessary to additionally provide a biasing mechanism (such as the biasing member) for securing the fixing unit to the image formation device body, and a release mechanism (such as the operation lever) for releasing the securing of the fixing unit. Such necessity increases the number of parts, leading to the increase in costs.

The present invention has been made in view of the above points, and is aimed at positioning the fixing unit with high accuracy and ensuring a good attachability and a good detachability of the fixing unit while keeping the number of parts small.

Means for Solving the Problem

An image formation device according to the present invention includes a fixing unit that causes a sheet carrying a toner image to pass through a nipping part formed by bringing a rotary fixing member and a rotary pressure member into pressure contact with each other, so as to fix the toner image to the sheet, and an image formation device body having a fixing unit housing part that the fixing unit is to be removably housed in.

An inserting and withdrawing direction of the fixing unit with respect to the fixing unit housing part agrees with an axial direction of the rotary pressure member, and a skeletal frame of the image formation device includes columns making a pair that are so arranged as to be adjacent to the fixing unit housing part and spaced apart in the inserting and withdrawing direction of the fixing unit, and lateral beams making a pair that are orthogonally connected to the columns making a pair, respectively, as viewed in the inserting and withdrawing direction and support a bottom face of the fixing unit. The image formation device includes: a driven gear integrally-rotatably coupled to a far end portion in the inserting and withdrawing direction of the rotary fixing member or the rotary pressure member of the fixing unit; a driving gear provided in a far end portion in the inserting and withdrawing direction of the fixing unit housing part and configured to engage with the driven gear when the fixing unit is housed in the fixing unit housing part; and a drive source to rotatively drive the driving gear. The driving gear and the driven gear are formed so that, during power transmission, a transmission force transmitted from a tooth flank of the driving gear to a tooth flank of the driven gear in a mutual engagement position has a component so directed as to horizontally press the fixing unit against the columns making a pair, and the fixing unit as housed in the fixing unit housing part is pressed by the transmission force against the columns making a pair, and positioned in a direction orthogonal to the inserting and withdrawing direction.

Effect of the Invention

According to the present invention, it is possible with a small number of parts to position the fixing unit with high accuracy and ensure a good attachability and a good detachability of the fixing unit.

MODE FOR CARRYING OUT THE INVENTION

In the following, an embodiment of the present invention is described in detail, based on the drawings. The present invention is not limited to the embodiment described below.

Embodiment

Figure 1:
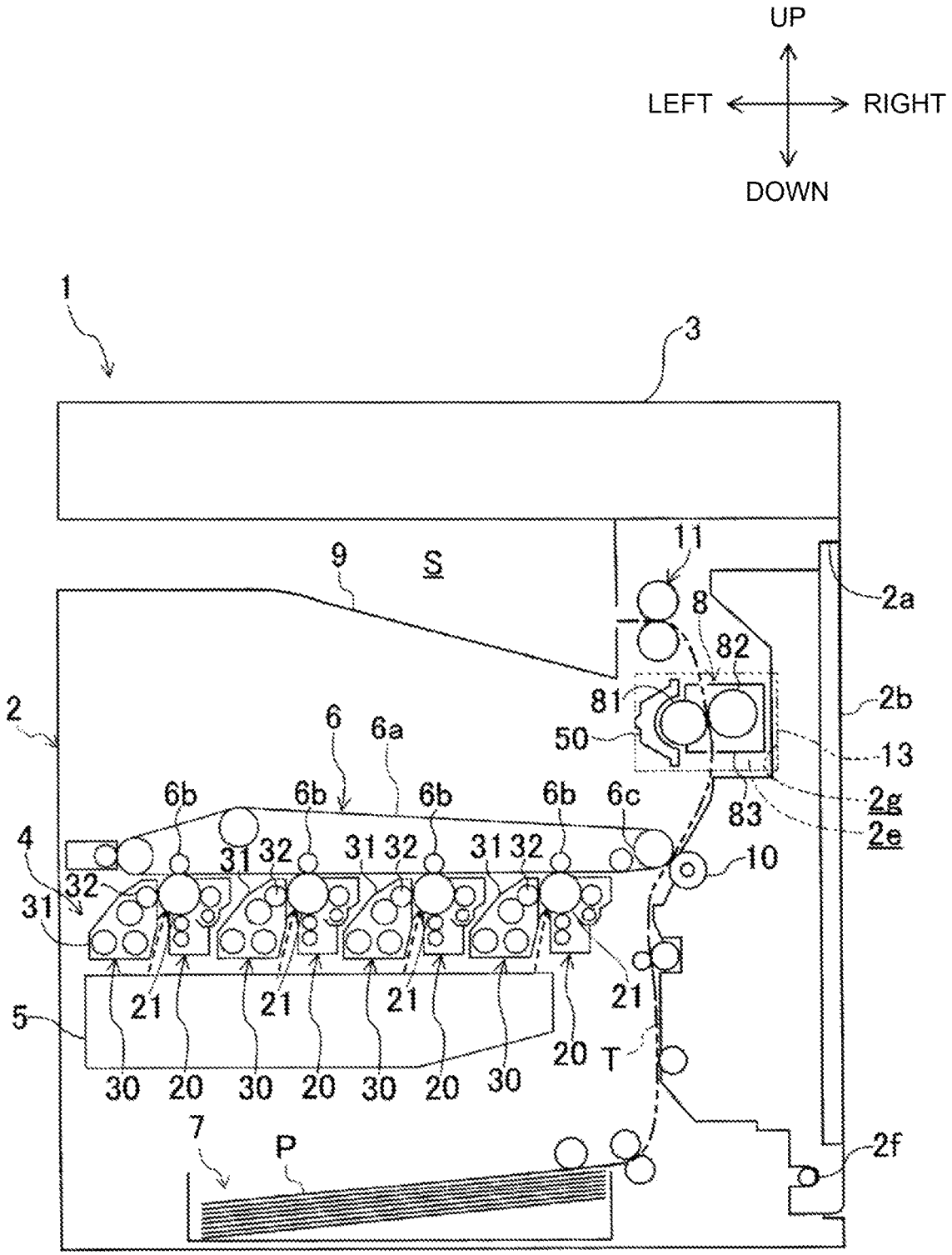
FIG. 1 is a schematic diagram illustrating an image formation device in an embodiment.

FIG. 1 is a schematic configurational diagram illustrating an image formation device 1 in an embodiment. In the description below, a front side and a rear side refer to a front side and a rear side of the image formation device 1 (ahead of and behind a drawing plane of FIG. 1 in a direction perpendicular to the drawing plane), respectively, and a left side and a right side refer to a left side and a right side of the image formation device 1 as viewed from the front side, respectively.

[General Configuration of Image Formation Device 1]

The image formation device 1 is a copying machine of an in-body paper discharge type, and includes an image formation device body 2 and an image reader 3 provided above the image formation device body 2. The image reader 3 optically reads an original image and generates image data of the original image.

An image forming section 4 to transfer and form an image on a paper sheet P (an example of a sheet) based on the image data of the original read by the image reader 3 is provided in the image formation device body 2. Above the image forming section 4, a transfer unit 6 is arranged. The transfer unit 6 includes an intermediate transfer belt 6*a* in an endless form extending in a left and right direction, and four primary transfer rollers 6*b* so arranged inside the intermediate transfer belt 6*a* as to align with one another in the left and right direction.

Exposure equipment 5 that emits laser light is arranged below the image forming section 4. Below the exposure equipment 5, a paper feeding section 7, where the paper sheet P is stored, is arranged. A fixing unit 8 that performs a fixing treatment on the image transferred and formed on the paper sheet P is arranged at an upper right of the transfer unit 6. An in-body paper discharge space S, where the paper sheet P as subjected to the fixing treatment by the fixing unit 8 is discharged, is provided between the image formation device body 2 and the image reader 3.

A paper discharge tray part 9 for receiving the paper sheet P discharged into the in-body paper discharge space S is formed at a top face of the image formation device body 2. In the image formation device body 2, a paper sheet conveyance path T extending from the paper feeding section 7 toward the paper discharge tray part 9 is provided. A secondary transfer roller 10 facing a driving roller 6*c* for the intermediate transfer belt 6*a* across the belt is provided below the fixing unit 8 on the paper sheet conveyance path T. A paper discharge roller pair 11 that discharges the paper sheet P toward the paper discharge tray part 9 nearly horizontally is provided above the fixing unit 8 on the paper sheet conveyance path T.

In a right side face of the image formation device body 2 adjacent to the paper sheet conveyance path T, an opening 2*a* in rectangular shape is formed. The opening 2*a* is closable with an openable cover 2*b*. The openable cover 2*b* is pivotably supported on a support shaft 2*f* extending along a lower edge of the opening 2*a*. The openable cover 2*b* in a closed state is pivoted on the support shaft 2*f* toward the right side and thus opened. A jamming paper sheet having blocked the paper sheet conveyance path T can be disposed by opening the openable cover 2*b*.

The image forming section 4 includes drum units 20 and development units 30 provided for yellow, magenta, cyan, and black colors, respectively. The drum units 20 each include a photosensitive drum 21 that is rotatable. A surface of the photosensitive drum 21 is irradiated with laser light from the exposure equipment 5 based on specified image data so as to form an electrostatic latent image on the surface.

The development units 30 each include a development vessel 31 and a development roller 32. Each development vessel 31 is fed with toner as a developer from a toner container (not illustrated) for a corresponding color and contains the toner. The development roller 32 is so formed as to be rotatable while exposed through a right side wall of an upper portion of the development vessel 31. The development roller 32 generates a potential difference between the development roller 32 itself and the surface of the photosensitive drum 21 so as to cause the toner to fly to the surface of the photosensitive drum 21. The electrostatic latent image on the surface of the photosensitive drum 21 is developed with the toner flying from the development roller 32 and thus visualized.

Toner images in the respective colors on the respective photosensitive drums 21 as visualized by the development units 30 are sequentially transferred to the intermediate transfer belt 6*a* under bias applied by the primary transfer rollers 6*b* arranged above the respective photosensitive drums 21, and superposed on one another. The superposed toner images are transferred to the paper sheet P fed from the paper feeding section 7 when the paper sheet P passes between the intermediate transfer belt 6*a* and the secondary transfer roller 10. The paper sheet P, to which the toner images have been transferred, is sent to the fixing unit 8.

The fixing unit 8 includes a fixing roller 81 and a pressure roller 82 that face each other in the left and right direction across the paper sheet conveyance path T. The fixing unit 8 holds and conveys the paper sheet P carrying the toner images with the fixing roller 81 and the pressure roller 82. The toner images on the paper sheet P are heated and put under pressure during the passing between the fixing roller 81 and the pressure roller 82, so as to thermally fix the toner images to the paper sheet P. The paper sheet P, to which the toner images have thermally been fixed, is discharged to the paper discharge tray part 9 by the paper discharge roller pair 11 arranged above the fixing unit 8.

[Housing Structure for Fixing Unit 8]

Next, a structure for housing the fixing unit 8 in the image formation device body 2 is described.

The image formation device body 2 includes a body frame 12 formed by combining a plurality of columns and lateral beams of metal (see FIG. 2 and the like), and exterior covers (not illustrated) covering side faces of the body frame 12, respectively. The columns and lateral beams are formed of hollow pipes with a cross section in substantially rectangular shape, for instance.

In an upper right portion of an exterior cover covering a front side face of the body frame 12, an openable maintenance door 13 (only illustrated in FIG. 1) is provided. A fixing unit housing part 2*e* that the fixing unit 8 is to be removably housed in is provided in a place opposite to an inside face of the maintenance door 13. The fixing unit housing part 2*e* is constituted of a hollow, spatial part extending in a front and rear direction, and has a front side end portion (one side end portion) where an insertion and withdrawal port 2*g* for inserting and withdrawing the fixing unit 8 is provided.

[Detailed Configuration of Fixing Unit Housing Part 2*e*]

Figure 2:
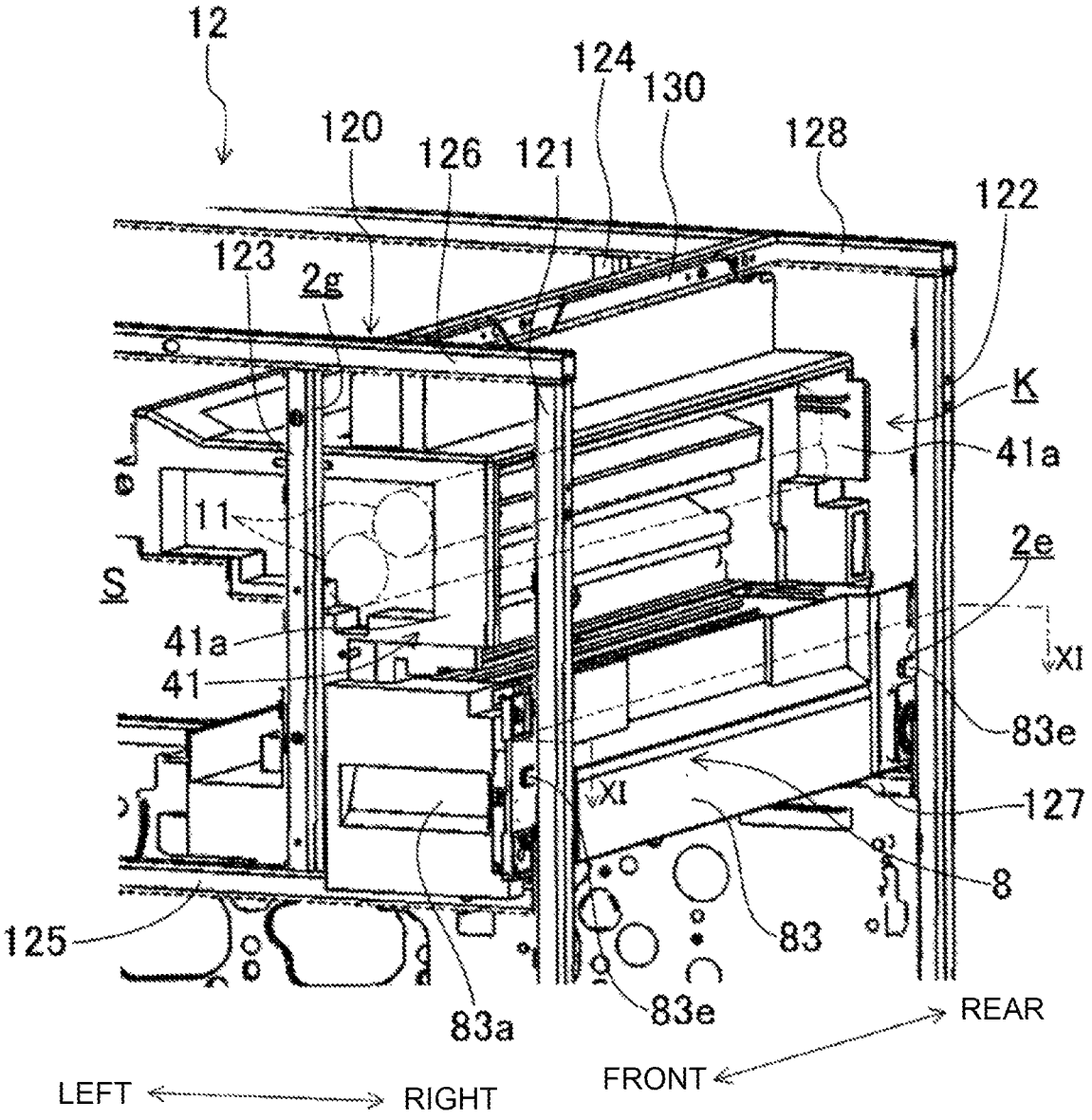
FIG. 2 is a perspective view of a right end portion of a body frame as obliquely viewed from a front right side, illustrating a state where a fixing unit is installed in a fixing unit housing part.
Figure 3:
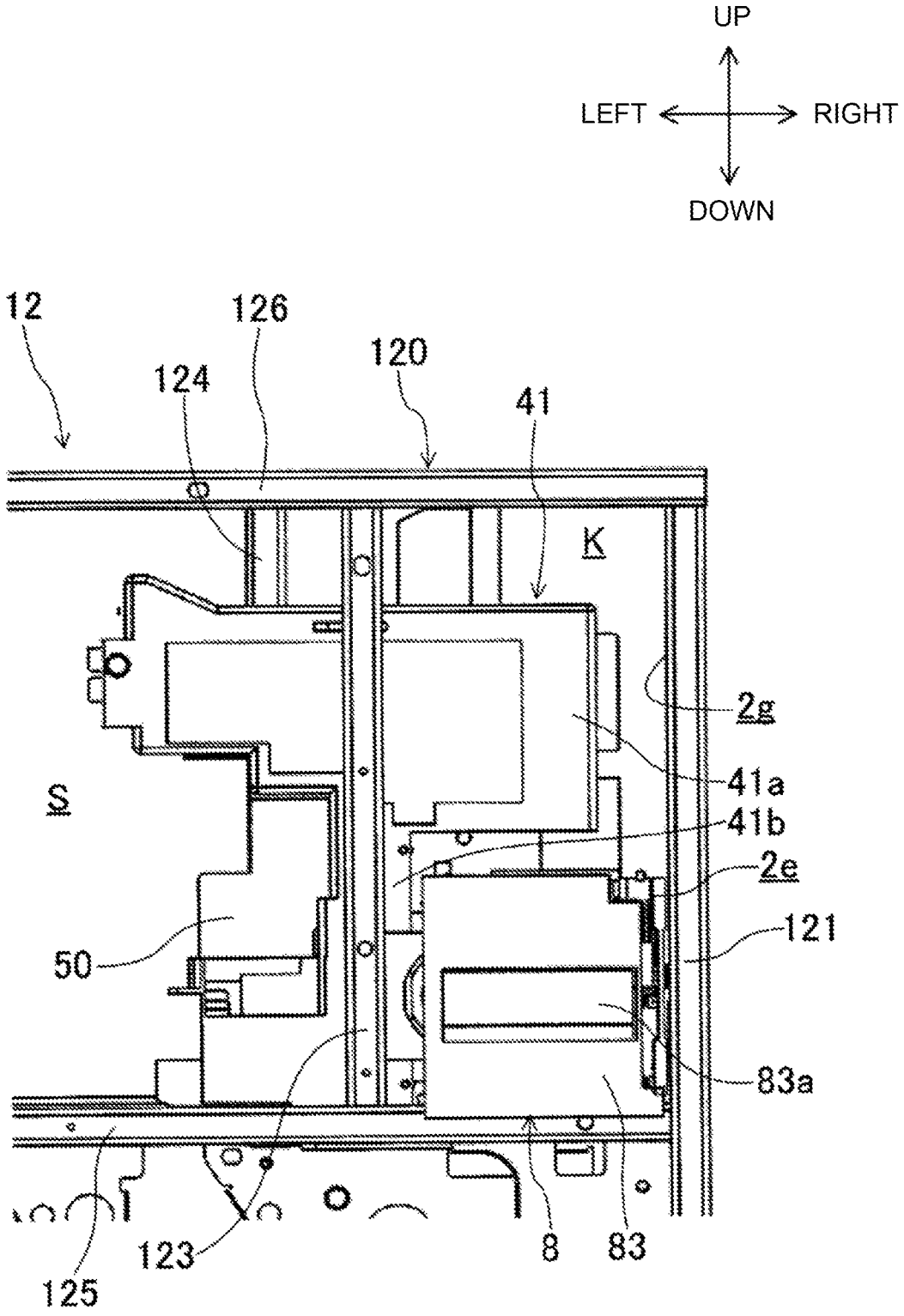
FIG. 3 is a front view of the right end portion of the body frame as viewed from a front side, illustrating the state where the fixing unit is installed in the fixing unit housing part.
Figure 4:
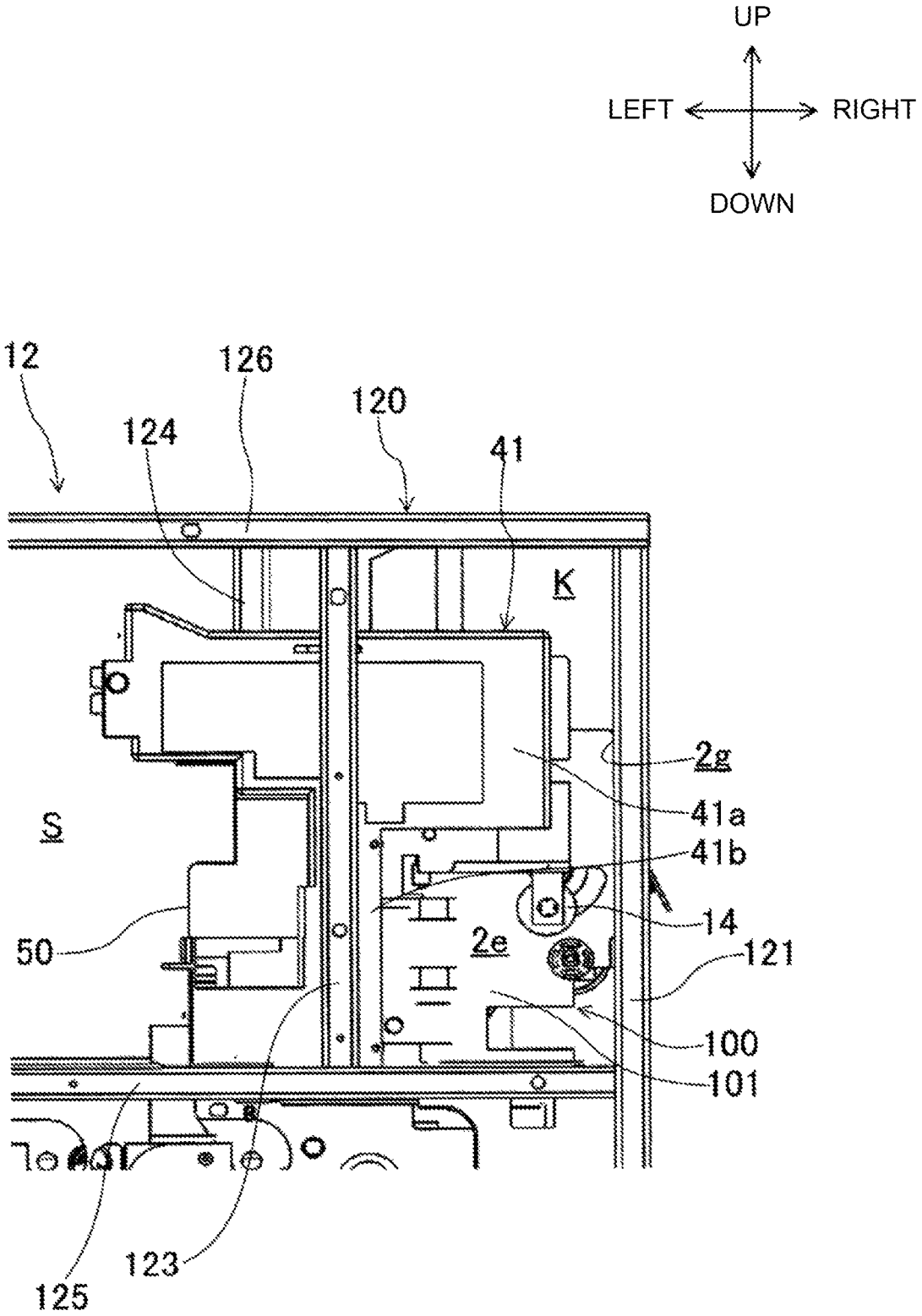
FIG. 4 is a front view of the right end portion of the body frame as viewed from the front side, illustrating a state where the fixing unit is removed from the fixing unit housing part.

Referring to FIGS. 2 through 4, the fixing unit housing part 2*e* is detailed. In the respective figures, the exterior covers and the maintenance door 13 are not illustrated. FIG. 2 is a perspective view illustrating a state where the fixing unit 8 is installed in the fixing unit housing part 2*e*, FIG. 3 is a front view illustrating such state, and FIG. 4 is a front view illustrating a state where the fixing unit 8 is removed from the fixing unit housing part 2*e*.

The fixing unit housing part 2*e* is provided in a lower portion of an inside space K of a protruding frame part 120 provided on the body frame 12. The protruding frame part 120 is adjacent to the right of the in-body paper discharge space S and is provided over the whole of the body frame 12 in the front and rear direction. The protruding frame part 120 is assembled from frame members in the form of a perpendicular parallelepiped.

Specifically, the protruding frame part 120 includes a front side right column 121, a rear side right column 122, a front side left column 123, and a rear side left column 124 arranged at four corners in plane vision. The front side right column 121 and the rear side right column 122 are adjacent to the fixing unit housing part 2*e* at the right of this part, and are spaced apart in the front and rear direction. The front side left column 123 and the rear side left column 124 are adjacent to the fixing unit housing part 2*e* at the left of this part, and are spaced apart in the front and rear direction. The front side right column 121 and the rear side right column 122 serve as a pair of columns for positioning the fixing unit 8 in the left and right direction.

The front side right column 121 and the front side left column 123 are coupled to each other by a lower coupling beam 125 and an upper coupling beam 126 each extending in the left and right direction. The front side right column 121, the front side left column 123, the lower coupling beam 125, and the upper coupling beam 126 cooperate with one another to form a rectangular frame part extending in an up and down direction. The inside of this rectangular frame part constitutes an insertion port 2*g* for inserting the fixing unit 8 into the fixing unit housing part 2*e*. The insertion port 2*g* is also used as a port for inserting and withdrawing a discharge unit 40. The fixing unit 8 is so formed as to be insertable into and withdrawable from the fixing unit housing part 2*e* through the insertion port 2*g*. An inserting and withdrawing direction of the fixing unit 8 agrees with a front and rear direction of the image formation device 1.

The rear side right column 122 and the rear side left column 124 are coupled to each other by a lower coupling beam 127 and an upper coupling beam 128 each extending in the left and right direction. The rear side right column 122, the rear side left column 124, the lower coupling beam 127, and the upper coupling beam 128 cooperate with one another to form a rectangular frame part extending in the up and down direction. Inside this rectangular frame part, a drive unit 100 (see two-dot chain lines in FIG. 9) for rotatively driving the pressure roller 82 of the fixing unit 8 is arranged. In the protruding frame part 120, the upper coupling beam 126 on the front side and the upper coupling beam 128 on the rear side are coupled to each other by a front and rear beam 130 (see FIG. 2) extending in the front and rear direction.

In the inside space K of the protruding frame part 120, the discharge unit 40 including the paper discharge roller pair 11 is housed. The fixing unit housing part 2*e* is formed of a bottom space lower than the paper discharge roller pair 11 in the inside space K.

[Configuration of Discharge Unit 40]

Figure 5:
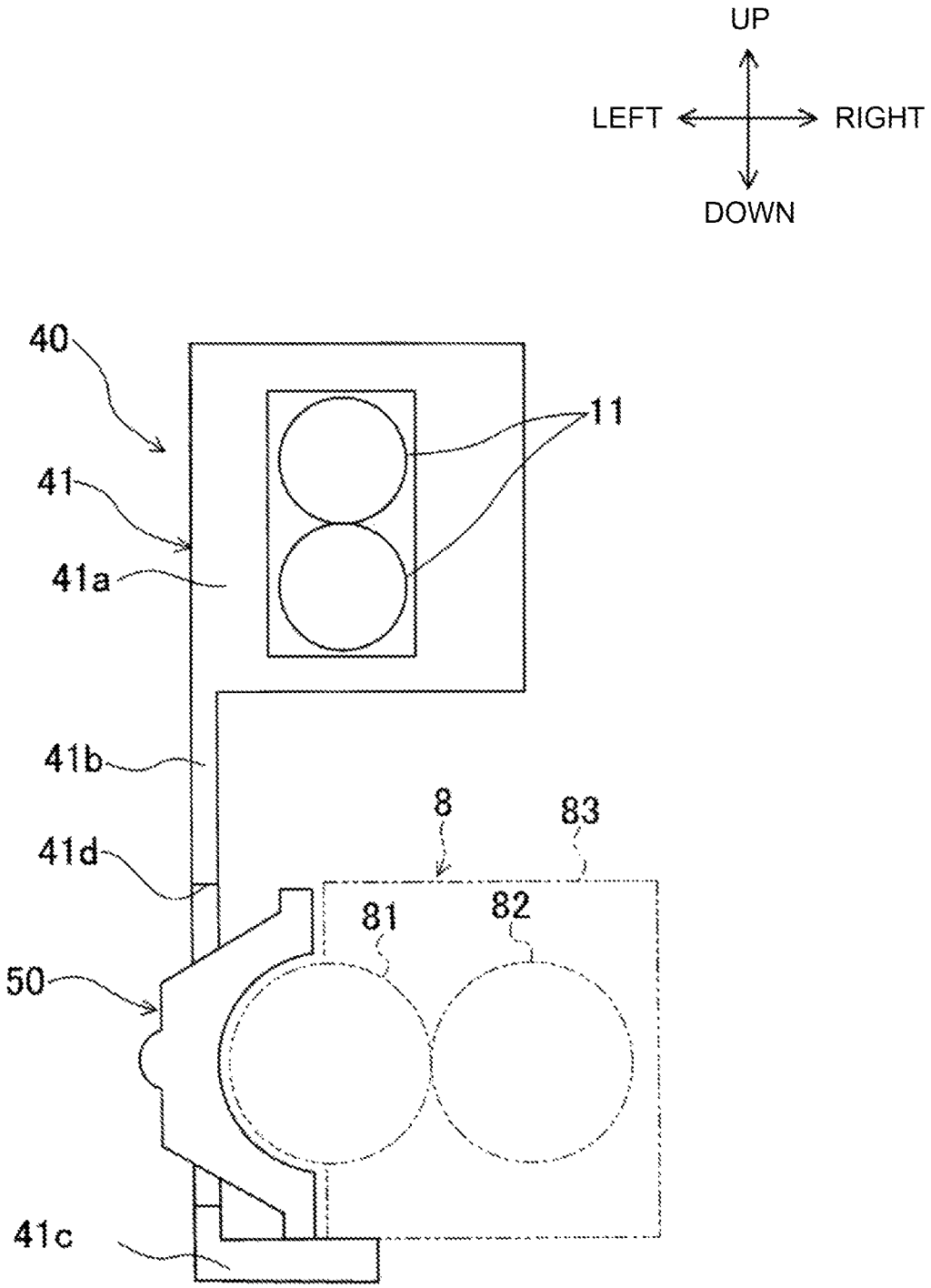
FIG. 5 is a front view of a discharge unit as viewed from the front side.

As illustrated in FIG. 5, the discharge unit 40 includes the paper discharge roller pair 11 and a support frame 41 supporting the paper discharge roller pair 11. The support frame 41 includes opposite plates 41*a* making a pair that support both axial end portions of the paper discharge roller pair 11, a vertical plate 41*b* that couples left end portions of the opposite plates 41*a* making a pair to each other and extends in the up and down direction, and a horizontal protrusion plate 41*c* that horizontally protrudes from a lower end portion of the vertical plate 41*b* to the right side. On an upper face of the horizontal protrusion plate 41*c*, an IH (induction heating) heating unit 50 to heat the fixing roller 81 is supported. An opening 41*d* that the IH heating unit 50 passes through is formed in the vertical plate 41*b*. At the time of insertion and withdrawal of the fixing unit 8, a right side edge portion of the horizontal protrusion plate 41*c* supports a left side edge portion of a bottom face of the fixing unit 8 slidably in the front and rear direction.

[Configuration of Fixing Unit 8 and IH Heating Unit 50]

Figure 6:
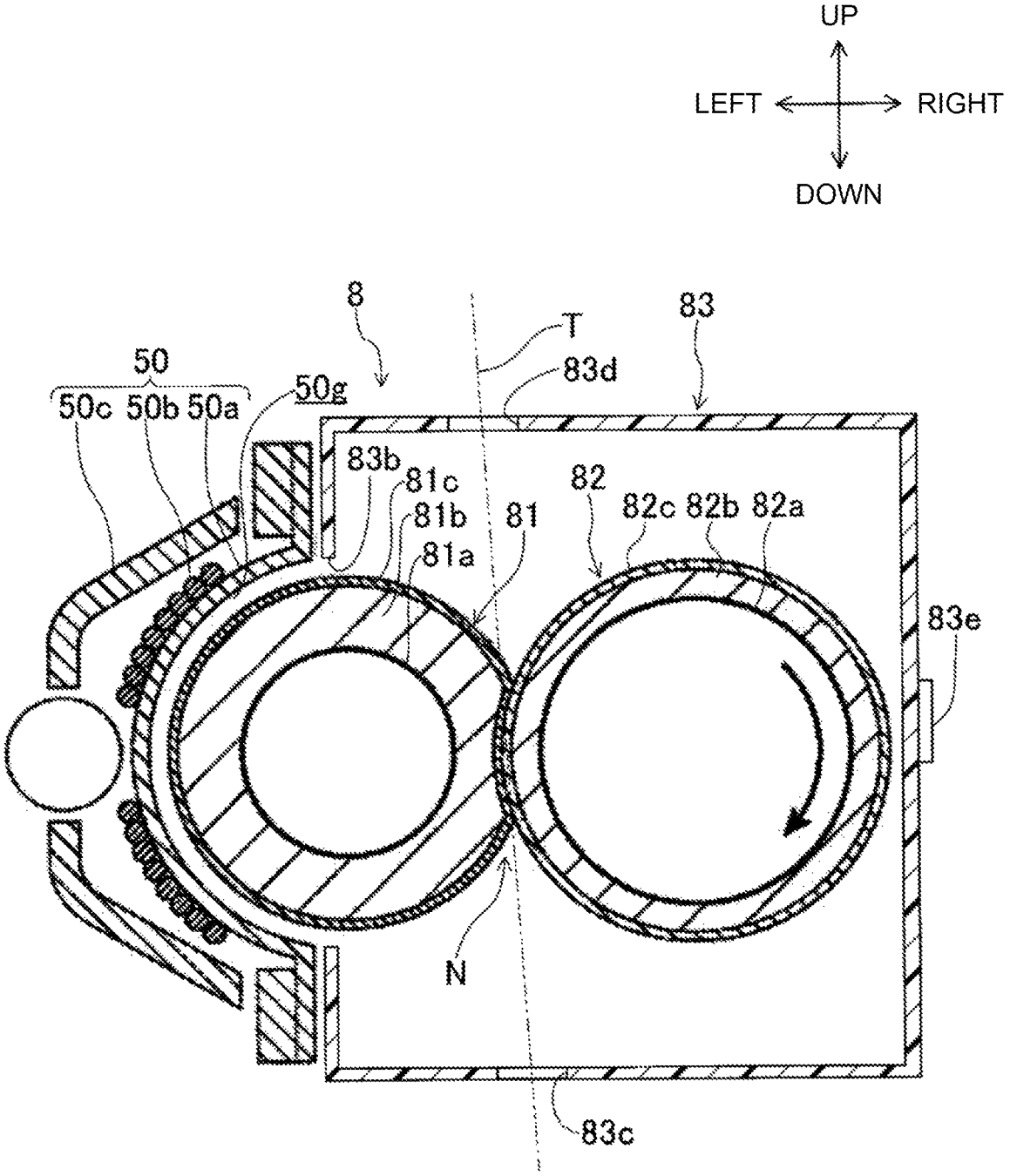
FIG. 6 is a cross-sectional view of a central portion of the fixing unit, taken at a vertical plane extending in a left and right direction.

FIG. 6 is a vertical cross-sectional view of central portions in the front and rear direction of the fixing unit 8 and the IH heating unit 50. The fixing unit 8 includes the fixing roller 81 and the pressure roller 82 as described above, and a fixing case 83.

The fixing roller 81 and the pressure roller 82 are each formed in nearly cylindrical shape elongated in the front and rear direction. The fixing roller 81 is provided with an elastic layer 81*b* formed on a peripheral face of a metallic core rod 81*a*, and a fixing belt 81*c* covering a peripheral face of the elastic layer 81*b*. The pressure roller 82 is provided with an elastic layer 82*b* formed on a peripheral face of a core rod 82*a*, and a mold release layer 82*c* covering a peripheral face of the elastic layer 82*b*.

The fixing case 83 is formed in nearly rectangular-parallelepipedic shape elongated in the front and rear direction. In a bottom face of the fixing case 83, a paper sheet inlet 83*c* for accepting the paper sheet P conveyed from an upstream side of the paper sheet conveyance path T is formed. In a top face of the fixing case 83, a paper sheet outlet 83*d* for discharging the paper sheet P having passed through the fixing roller 81 and the pressure roller 82 is formed. In a left side wall of the fixing case 83, an opening 83*b* in rectangular shape extending in the left and right direction is formed, and a left side half portion of the fixing roller 81 is exposed out of the fixing case 83 through the opening 83*b*.

The IH heating unit 50 is provided on a side (left side) of the fixing roller 81 opposite to a nipping part N side. The IH heating unit 50 includes a holder 50*a* in semicylindrical shape opening toward the fixing roller 81, a plurality of IH coils 50*b* supported by the holder 50*a*, and an arch core 50*c* formed of a ferromagnetic material such as ferrite that covers the IH coils 50*b*. An inner face of the holder 50*a* shapes a concave portion 50*g* in semicylindrical shape. In the state where the IH heating unit 50 is in a heating position, a facial portion of the fixing roller 81 on the side opposite to the nipping part N side comes into the concave portion 50*g*. Both the holder 50*a* and the arch core 50*c* face the fixing roller 81 and are so provided as to extend over the whole of the fixing roller 81 in the front and rear direction.

[Operation of Fixing Unit 8]

During the fixing treatment, the pressure roller 82 receives a driving force from the drive unit 100 to be described later and rotates on an axis. The fixing roller 81 moves following the pressure roller 82 and rotates on an axis. Each IH coil 50*b* is fed with electricity from a power source (not illustrated) so as to generate a high frequency magnetic field and heat the fixing belt 81*c*. The fixing roller 81 heats, while rotating, the toner images on the paper sheet P passing through a nipping part N. The pressure roller 82 puts, while rotating, the paper sheet P passing through the nipping part N under pressure. As a result, the toner images are fixed to the paper sheet P.

[Detailed Configuration of Fixing Case 83]

Figure 7:
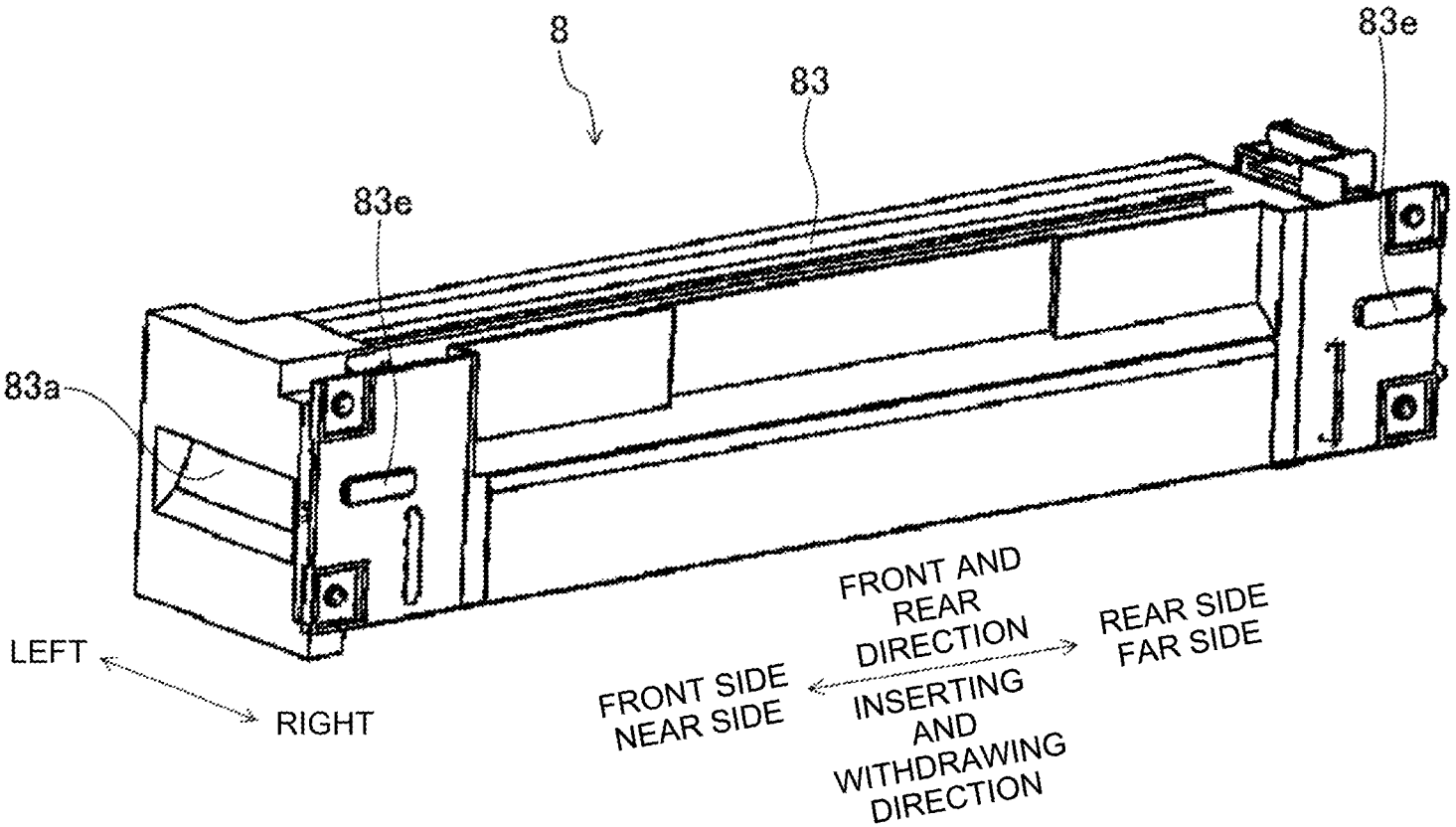
FIG. 7 is a perspective view of the fixing unit as obliquely viewed from the front right side.
Figure 8:
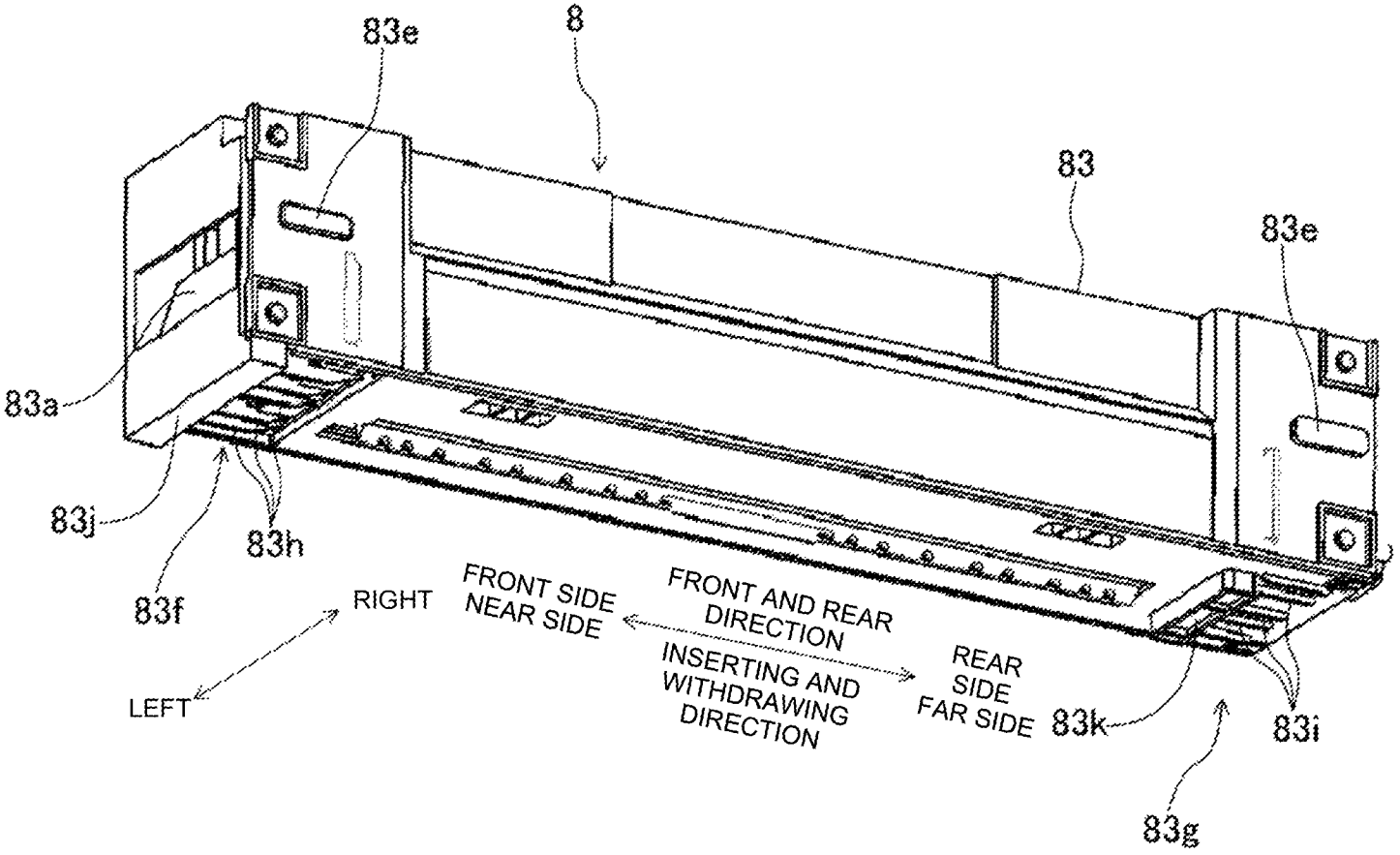
FIG. 8 is a perspective view of the fixing unit as obliquely viewed from a front lower right.

As illustrated in FIGS. 7 and 8, a hold 83*a* in concave shape is formed at a front side face of the fixing case 83. An operator slides the fixing case 83 rearward and forward with fingers laid on the hold 83*a*, so as to insert and withdraw the fixing unit 8 with respect to the fixing unit housing part 2*e*.

In the state where the fixing unit 8 is housed in the fixing unit housing part 2*e* (state where installation has been completed), a front side end portion of the fixing case 83 is supported by the lower coupling beam 125 on the front side from below, and a rear side end portion of the fixing case 83 is supported by the lower coupling beam 127 on the rear side from below, as illustrated in FIG. 2. A left side edge portion of the fixing unit 8 is supported by the horizontal protrusion plate 41*c* (only illustrated in FIG. 5) of the discharge unit 40.

A position in the left and right direction (position in a direction orthogonal to the inserting and withdrawing direction) of the fixing case 83 is settled if a right side face of the fixing case 83 abuts the front side right column 121 and the rear side right column 122. To be specific: In end portions in the front and rear direction of the right side face of the fixing case 83, abutment seats 83*e* in flat, rectangular shape elongated in the front and rear direction are protrusively provided, respectively. End faces on a protrusion side of the abutment seats 83*e* are so formed as to be higher in surface roughness and flatness than any other part on the right side face of the fixing case 83. When the abutment seats 83*e* in the front and the rear abut the front side right column 121 and the rear side right column 122, respectively, the fixing case 83 is positioned in the left and right direction.

As illustrated in FIG. 8, a front side supported part 83*f* to be supported by the lower coupling beam 125 on the front side is formed in a front side end portion of the bottom face of the fixing case 83. The front side supported part 83*f* is constituted of a plurality of rib plates 83*h* spaced apart in the left and right direction. A rear side supported part 83*g* to be supported by the coupling beam 127 on the rear side is formed in a rear side end portion of the bottom face of the fixing case 83. The rear side supported part 83*g* is constituted of a plurality of rib plates 83*i* spaced apart in the left and right direction. The supported parts 83*f* and 83*g* are formed with the rib plates 83*h* and the rib plates 83*i*, respectively, so as to reduce frictional force generated between the coupling beams 125 and 127 on the front and rear sides and the fixing case 83 at the time of insertion and withdrawal of the fixing case 83.

In a portion of the fixing case 83 adjacent to the front of the front side supported part 83*f*, a front side insertion regulator 83*j* is provided. The front side insertion regulator 83*j* is constituted of a lower end portion of a front side wall of the fixing case 83 and protrudes downward beyond lower edges of the respective rib plates 83*h*. In a portion of the fixing case 83 adjacent to the front of the rear side supported part 83*g*, a rear side insertion regulator 83*k* protruding downward beyond lower edges of the respective rib plates 83*i* is formed. When the fixing unit 8 is inserted into the fixing unit housing part 2*e*, the front side insertion regulator 83*j* and the rear side insertion regulator 83*k* abut the lower coupling beam 125 on the front side and the lower coupling beam 127 on the rear side, respectively, so as to regulate excessive forcing in (insertion) of the fixing unit 8 and regulate the fixing unit 8 in a specified position in the front and rear direction. In the state where the fixing unit 8 is regulated in the specified position in the front and rear direction, a rear end portion of the fixing unit 8 is coupled to the drive unit 100 (see the two-dot chain lines in FIG. 9) in a manner allowing power transmission.

[Configuration of Drive Unit 100]

Figure 9:
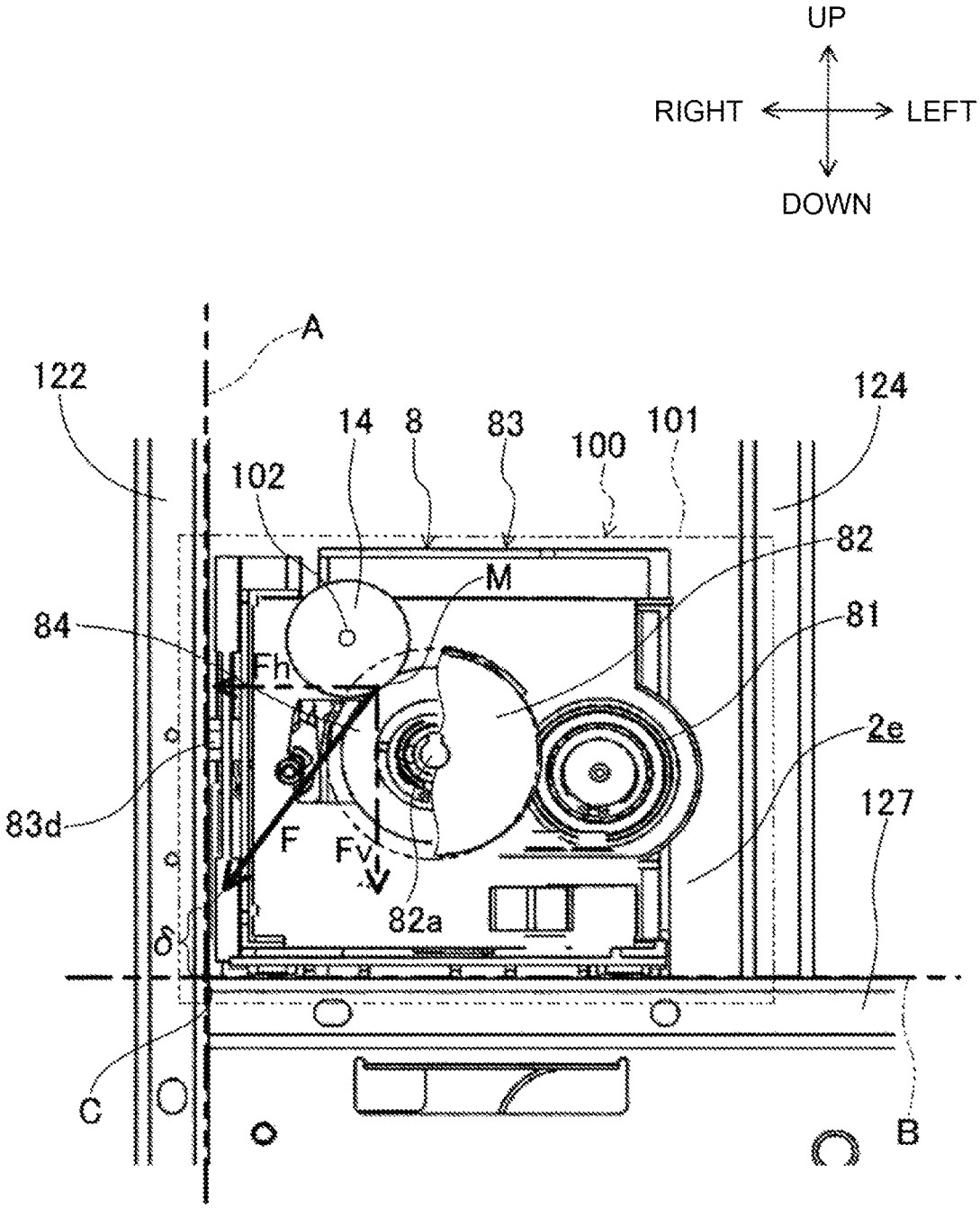
FIG. 9 is a rear view of the right end portion of the body frame as viewed from a rear side, illustrating part of a drive unit for driving the fixing unit with imaginary lines and a driving gear with a solid line.

As seen from FIG. 9, the drive unit 100 includes a case member 101 that is flat in the front and rear direction, a driving gear 14 supported on a shaft 102 protruding from a front side wall of the case member 101 toward the front side, a driving gear train not illustrated that is housed in the case member 101, and a motor (drive source) not illustrated that rotatively drives the driving gear 14 through the driving gear train.

When the fixing unit 8 is housed in the fixing unit housing part 2*e*, the driving gear 14 engages with a pressure roller gear 84 (an example of a driven gear). The pressure roller gear 84 is integrally-rotatably secured to the core rod 82*a* of the pressure roller 82.

Figure 10:
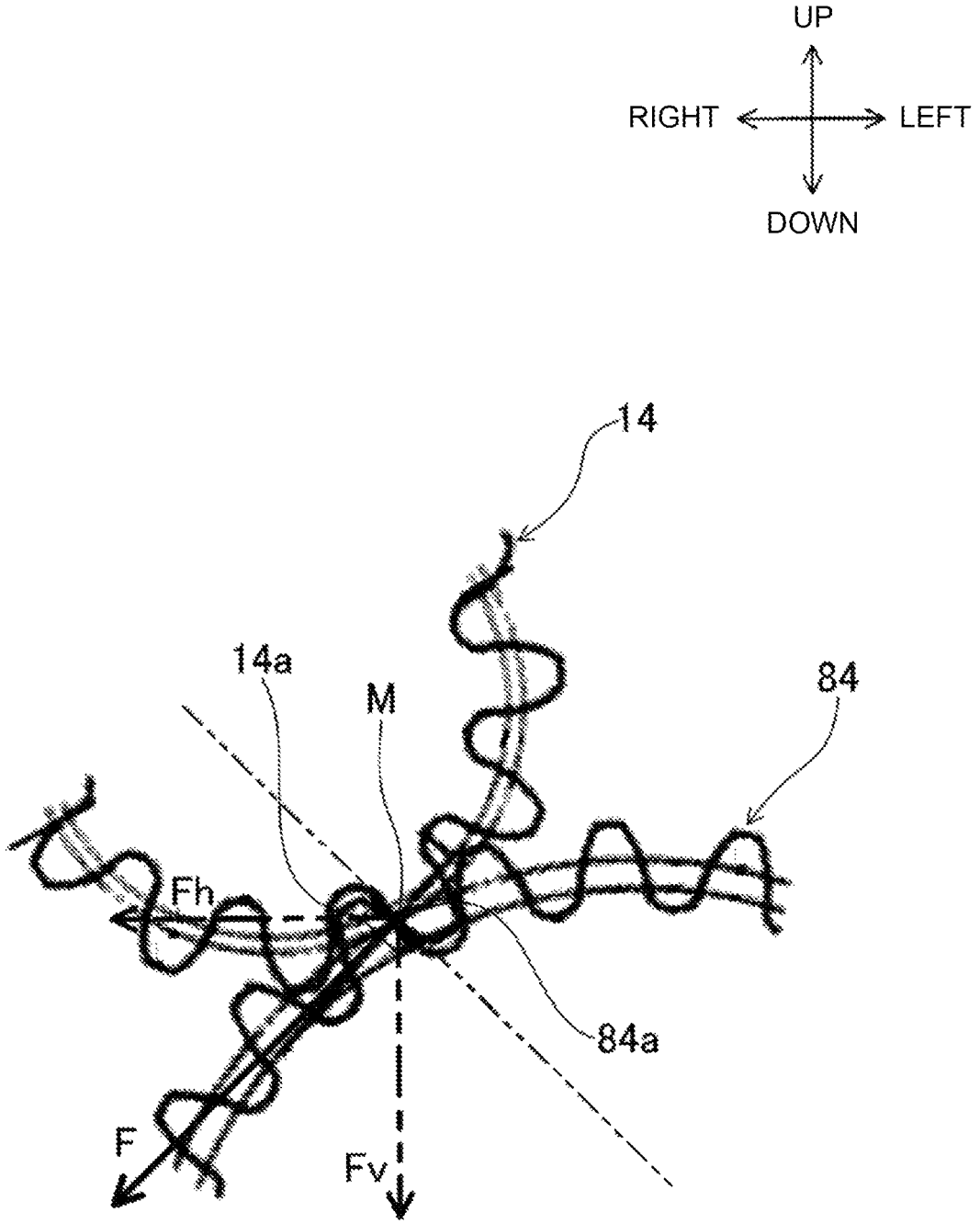
FIG. 10 is an enlarged view illustrating, in an enlarged manner, vicinity of a position where the driving gear and a pressure roller gear engage with each other.

FIG. 10 is a schematic diagram illustrating a state where the pressure roller gear 84 engages with the driving gear 14, as viewed in an axial direction. In the figure, a line indicated with a two-dot chain line is a common tangent to a tooth flank 14*a* of the driving gear 14 and a tooth flank 84*a* of the pressure roller gear 84 in an engagement position M, and a solid line arrow indicates a normal direction of the common tangent and represents, as a vector, a transmission force F transmitted from the tooth flank 14*a* of the driving gear 14 to the tooth flank 84*a* of the pressure roller gear 84.

The transmission force F is leaning downward to the right side (the left in FIGS. 9 and 10, namely, the side where the front side right column 121 and the rear side right column 122 are located). Therefore, the transmission force F has a horizontal component Fh that horizontally presses the fixing unit 8 against the front side right column 121 and the rear side right column 122, and a vertical component (force component vertically directed downward) Fv that presses the fixing unit 8 against the lower coupling beam 125 and the lower coupling beam 127. In the example in FIGS. 9 and 10, the horizontal component Fh and the vertical component Fv of the transmission force F are equal to each other.

An extension line of the transmission force F passes a position at a specified distance δ above in a vertical direction from a crossing position C where a vertical plane A including faces on a fixing unit housing part 2*e* side of the right columns 121 and 122 in the front and the rear and a horizontal plane B including upper faces of the lower coupling beams 125 and 127 in the front and the rear cross each other. The specified distance δ is set to ⅙ or more but not more than ⅕ of the height of the fixing case 83, for instance.

The fixing unit 8 is pressed by the horizontal component Fh of the transmission force F transmitted from the driving gear 14 to the pressure roller gear 84 against the front side right column 121 and the rear side right column 122 and thus positioned.

[Description on State of Positioning]

Figure 11:
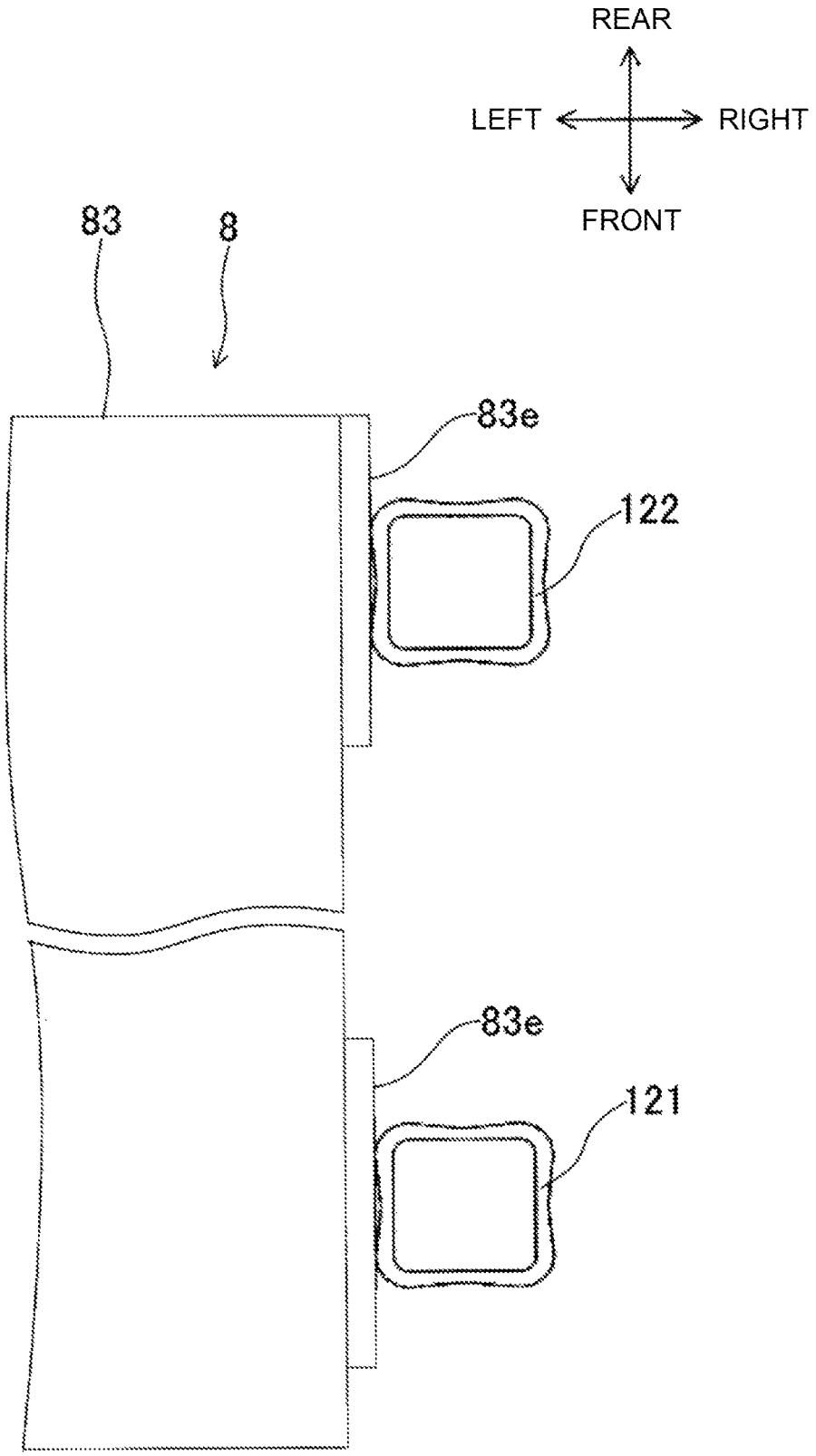
FIG. 11 is a cross-sectional view taken along a line XI-XI in FIG. 2.

FIG. 11 is a schematic plan view illustrating a state where the fixing unit 8 is pressed against the front side right column 121 and the rear side right column 122. As illustrated in this figure, the abutment seats 83*e* in the front and the rear of the fixing case 83 abut the front side right column 121 and the rear side right column 122, respectively from the left side, so as to position the fixing unit 8 in the left and right direction.

Figure 12:
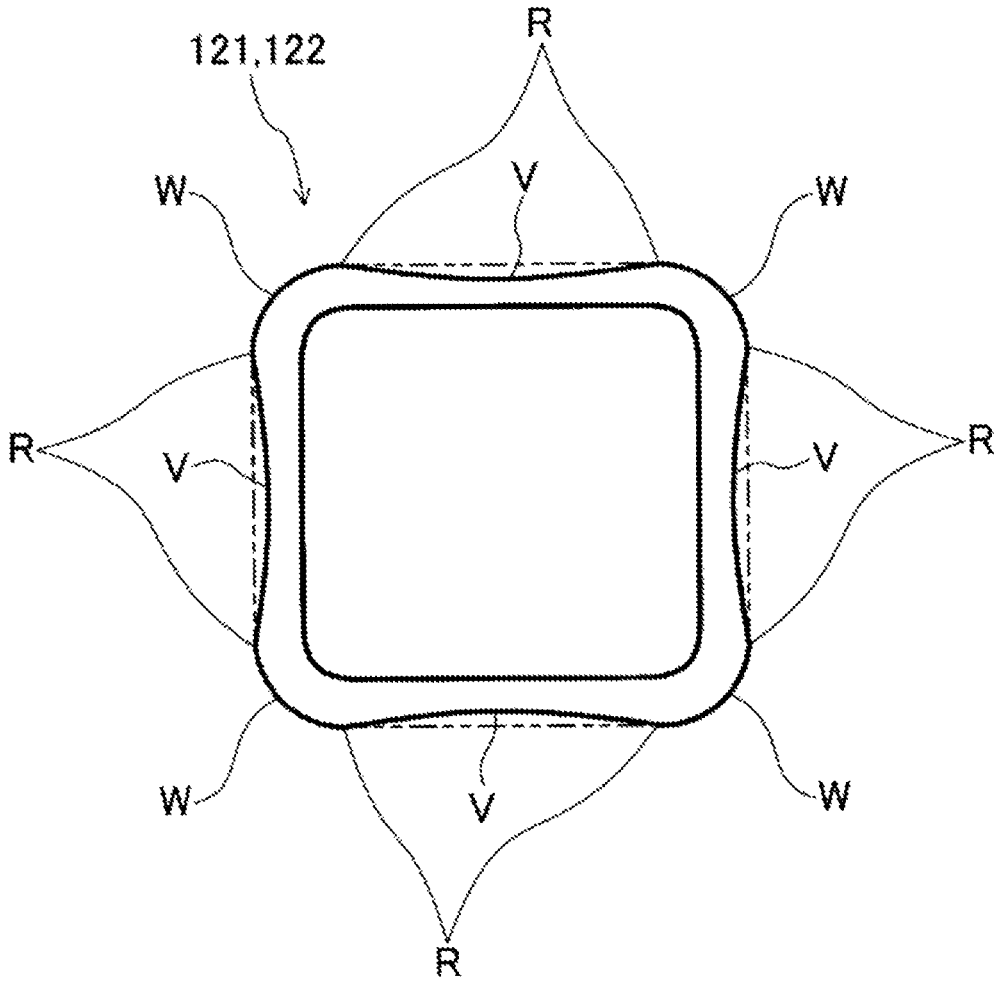
FIG. 12 is a cross-sectional view illustrating a cross-sectional shape of columns and lateral beams constituting a protruding frame part.

The front side right column 121 and the rear side right column 122 are so formed as to abut the abutment seats 83*e* in the front and the rear, respectively, not in surface contact but in line contact. In other words, the front side right column 121 and the rear side right column 122 each have four corners W each formed in the shape of a circular arc and arched recesses V each provided in a central portion in a width direction of a side face, as viewed in a cross section perpendicular to a column length direction illustrated in FIG. 12. In each of the columns 121 and 122, a ridge R extending in the column length direction is formed in either end position of each recess V (position of boundary between the relevant recess V and the shape of a circular arc of an adjacent corner W). When the fixing unit 8 is pressed against the front side right column 121 and the rear side right column 122, therefore, the ridges R of the respective columns 121 and 122 come into line contact with the fixing case 83, which makes it possible to position the fixing unit 8 with high accuracy as compared with the case of surface contact.

In the present embodiment, square pipes that are the same in cross-sectional shape as the front side right column 121 and the rear side right column 122 are used for all the columns and lateral beams constituting the body frame 12. Consequently, accuracy in positioning the fixing unit 8 with the lower coupling beam 125 (see FIG. 2) on the front side and the lower coupling beam 127 on the rear side in the up and down direction, for instance, is also improved.

Effects of Present Embodiment

As described above, in the present embodiment, the inserting and withdrawing direction (front and rear direction) of the fixing unit 8 with respect to the fixing unit housing part 2*e* agrees with an axial direction of the pressure roller 82. A skeletal frame of the image formation device 1 includes the front side right column 121 and the rear side right column 122, which are so arranged as to be adjacent to the fixing unit housing part 2*e* and spaced apart in the inserting and withdrawing direction of the fixing unit 8, and the lower coupling beam 125 and the lower coupling beam 127, which are orthogonally connected to the front side right column 121 and the rear side right column 122, respectively, as viewed in the inserting and withdrawing direction and support the bottom face of the fixing unit 8. The image formation device 1 includes: the pressure roller gear 84 integrally-rotatably coupled to a far end portion in the inserting and withdrawing direction of the pressure roller 82 of the fixing unit 8; the driving gear 14, which is provided in a far end portion in the inserting and withdrawing direction of the fixing unit housing part 2*e* and engages with the pressure roller gear 84 when the fixing unit 8 is housed in the fixing unit housing part 2*e*; and the drive source (not illustrated) to rotatively drive the driving gear 14. The driving gear 14 and the pressure roller gear 84 are formed so that, during the power transmission, the transmission force F transmitted from the tooth flank 14*a* of the driving gear 14 to the tooth flank 84*a* of the pressure roller gear 84 in the engagement position M of mutual engagement has the horizontal component Fh so directed as to horizontally press the fixing unit 8 against the front side right column 121 and the rear side right column 122. The fixing unit 8 as housed in the fixing unit housing part 2*e* is pressed by the horizontal component Fh of the transmission force F against the front side right column 121 and the rear side right column 122 and positioned in the direction (left and right direction) orthogonal to the inserting and withdrawing direction.

According to the configuration as above, the fixing unit 8 is pressed by the transmission force F transmitted from the driving gear 14 to the pressure roller gear 84 against the front side right column 121 and the rear side right column 122 and thus positioned simply by inserting the fixing unit 8 into the fixing unit housing part 2*e* from the front side so as to cause the image formation device 1 to perform a printing process. Consequently, structure is simplified as compared with a positioning structure where an engagement groove and an engagement pin are engaged with each other as in a conventional image formation device. It is unnecessary to additionally provide a biasing mechanism for securing the fixing unit 8 and a release mechanism for releasing the securing, so that the number of parts is decreased for the reduction in costs.

In the present embodiment, the driving gear 14 and the pressure roller gear 84 are formed so that, during the power transmission, the extension line of the transmission force F passes above the crossing position C where the vertical plane A, which includes the faces on the fixing unit housing part 2*e* side of the right columns 121 and 122 in the front and the rear, and the horizontal plane B, which includes the upper faces of the lower coupling beams 125 and 127 in the front and the rear, cross each other, as viewed in the inserting and withdrawing direction of the fixing unit 8 (see FIG. 9).

According to the configuration as above, the transmission force F generates a moment so directed as to cause the fixing unit 8 to rotate counterclockwise in FIG. 9 on the crossing position C as a fulcrum. As a result, a side face on the right side (the left in FIG. 9) of the fixing unit 8 is surely pressed against the front side right column 121 and the rear side right column 122 so as to improve, as much as possible, accuracy in positioning the fixing unit 8 in the left and right direction.

In the present embodiment, the driving gear 14 and the pressure roller gear 84 are formed so that, during the power transmission, the horizontal component Fh and the vertical component Fv of the transmission force F are equal to each other.

According to the configuration as above, the fixing unit 8 is equally pressed rightward in a horizontal direction and downward in the vertical direction. Consequently, the fixing unit 8 is prevented from coming up from the lower coupling beams 125 and 127 as a result of excessive pressing of the fixing unit 8 against the front side right column 121 and the rear side right column 122. Moreover, the accuracy in positioning the fixing unit 8 is improved both in the left and right direction and in the up and down direction.

In the present embodiment, the faces on the fixing unit housing part 2*e* side of the front side right column 121 and the rear side right column 122 are each so formed as to have two ridges R extending in the up and down direction and spaced apart in the inserting and withdrawing direction. The fixing unit 8 is so formed as to abut the two ridges R provided on each of the front side right column 121 and the rear side right column 122 when pressed by the horizontal component Fh of the transmission force F against the right columns 121 and 122.

According to the configuration as above, the fixing unit 8 abuts the front side right column 121 and the rear side right column 122 in line contact, so that the positioning in the left and right direction is performed with high accuracy as compared with the case of abutment in surface contact.

In the present embodiment, on the face (right side face in the present embodiment) of the fixing unit 8, which face is to be pressed against the front side right column 121 and the rear side right column 122, the abutment seats 83*e* making a pair, which abut the front side right column 121 and the rear side right column 122, respectively, are protrusively provided. The abutment seats 83*e* are each so formed as to be able to abut the two ridges R provided on one of the front side right column 121 and the rear side right column 122 when the fixing unit 8 is pressed against the right columns 121 and 122. Specifically, the abutment seats 83*e* each have a width set larger than the distance between the two ridges R.

According to the configuration as above, faces on the protrusion side of the abutment seats 83*e* are so formed as to be higher in surface precision than any other part, and the faces on the protrusion side of the protruding seats 83*e* higher in surface precision are caused to abut the ridges R of the front side right column 121 and the rear side right column 122 so as to improve, as much as possible, accuracy in positioning the fixing case 83 in the left and right direction.

«Modification 1»

Figure 13:
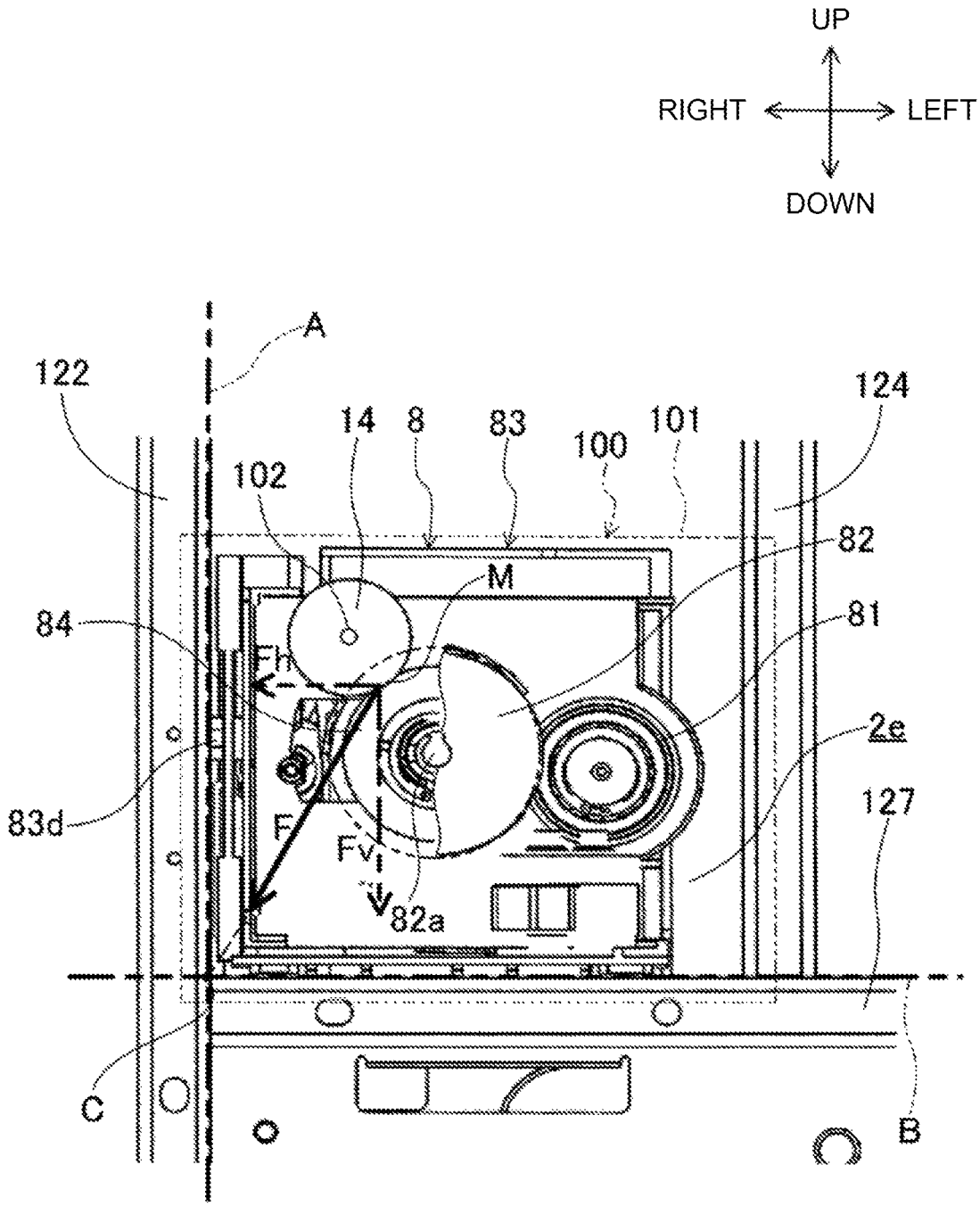
FIG. 13 is a view corresponding to FIG. 9, illustrating Modification 1.

FIG. 13 illustrates Modification 1 of the embodiment as described above. With respect to the modifications below, the same constituent elements as the constituent elements in FIG. 9 are given the same reference numerals and not detailed.

In this modification, the driving gear 14 and the pressure roller gear 84 are formed so that, during the power transmission, the extension line of the transmission force F passes the crossing position C where the vertical plane A, which includes the faces on the fixing unit housing part 2*e* side of the right columns 121 and 122 in the front and the rear, and the horizontal plane B, which includes the upper faces of the lower coupling beams 125 and 127 in the front and the rear, cross each other, as viewed in the inserting and withdrawing direction of the fixing unit 8.

According to the configuration as above, the extension line of the transmission force F passes the crossing position C as viewed in the inserting and withdrawing direction of the fixing unit 8, so that a moment about the crossing position C that acts on the fixing unit 8 is not generated. Consequently, a posture of the fixing unit 8 is prevented from dynamically changing due to a moment load caused by the transmission force F and, moreover, the accuracy in positioning the fixing unit 8 is improved in the left and right direction and the up and down direction.

«Modification 2»

Figure 14:
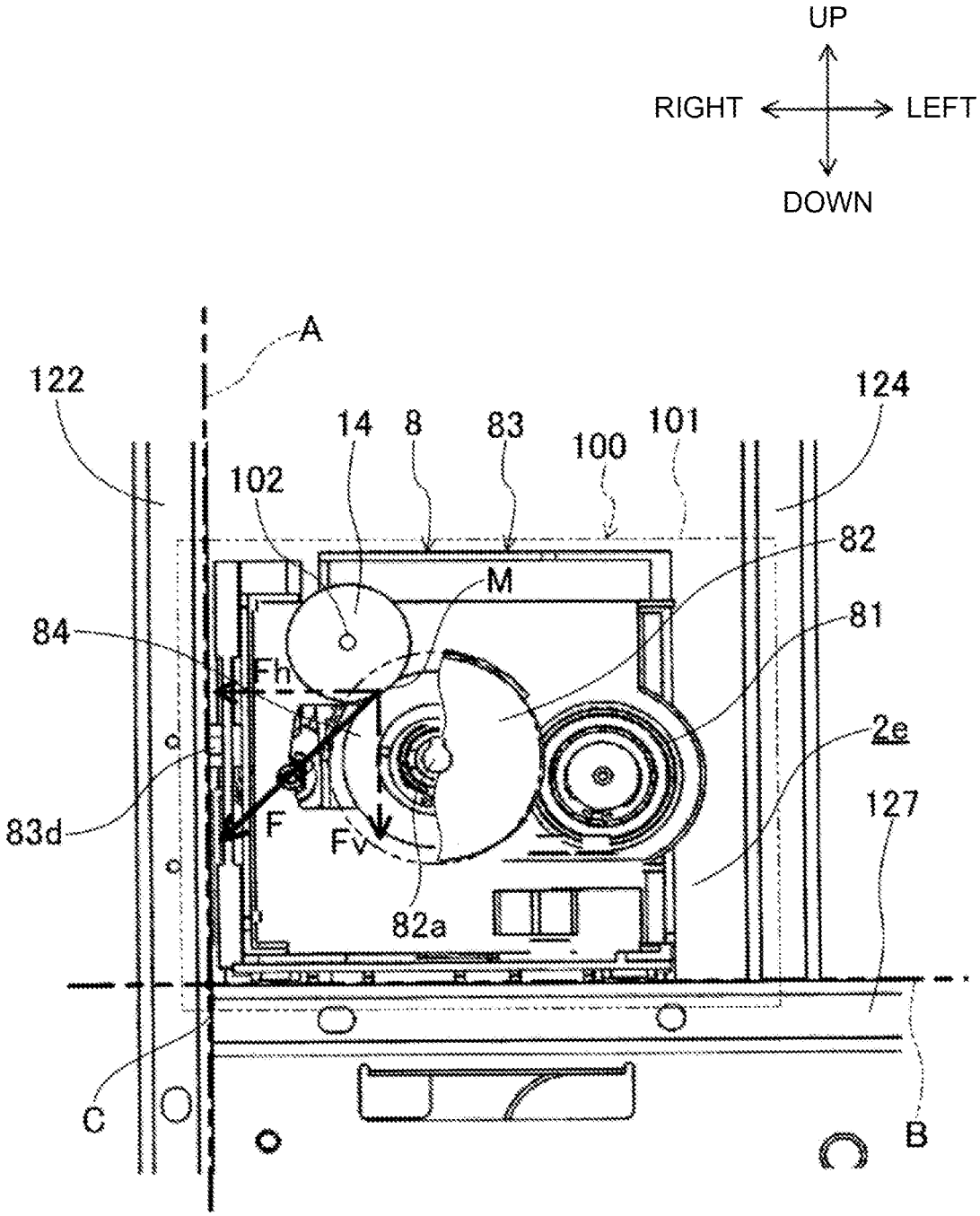
FIG. 14 is a view corresponding to FIG. 9, illustrating Modification 2.

FIG. 14 illustrates Modification 2 of the embodiment as described above. In this modification, the driving gear 14 and the pressure roller gear 84 are formed so that, during the power transmission, the horizontal component Fh of the transmission force F is larger than the vertical component Fv.

According to the configuration as above, the fixing unit 8 is pressed against the front side right column 121 and the rear side right column 122 more firmly as compared with the case where the horizontal component Fh and the vertical component Fv are equal to each other, so as to improve the accuracy in positioning the fixing unit 8 in the left and right direction. In this case, the vertical component Fv pressing the fixing unit 8 downward is reduced indeed, but the fixing unit 8 can be pressed against the lower coupling beams 125 and 127 in the front and the rear by gravity acting on the fixing unit 8 even if the vertical component Fv is small, so that the accuracy in positioning the fixing unit 8 in the up and down direction is not impaired.

Other Embodiments

In the embodiment and modifications as described above, the pressure roller 82 is assumed as a driving roller and the fixing roller 81 is assumed as a driven roller, to which the present invention is not limited, and the fixing roller 81 may be a driving roller and the pressure roller 82 may be a driven roller. In that case, the driven gear may integrally-rotatably be coupled to a drive shaft of the fixing roller 81 and the driving gear 14 may be engaged with such driven gear.

In the embodiment and modifications as above, the fixing roller 81 has been described as an exemplary rotary fixing member, while the rotary fixing member is not limited to such roller but may be a fixing belt in an endless form. Further, in the embodiment as above, the pressure roller 82 has been described as an exemplary rotary pressure member, while the rotary pressure member is not limited to such roller but may be a pressure belt in an endless form.

In the embodiment as above, the copying machine has been described as an example of the image formation device 1, while such example is not limitative. The image formation device 1 may be a printer, a facsimile machine, a copying machine or a multifunction peripheral (MFP).

INDUSTRIAL APPLICABILITY

As described above, the present invention is useful for image formation devices, and particularly useful if applied to a printer, a facsimile machine, a copying machine or a multifunction peripheral (MFP).

DESCRIPTION OF REFERENCE NUMERALS

1 image formation device
2 image formation device body
2*e* fixing unit housing part
8 fixing unit
14 driving gear
14*a* tooth flank
81 fixing roller (rotary fixing member)
82 pressure roller (rotary pressure member)
83*e* abutment seat
84 pressure roller gear (driven gear)
84*a* tooth flank

121 front side right column (column)
122 rear side right column (column)
125 lower coupling beam (lateral beam)
127 lower coupling beam (lateral beam)
C crossing position
F transmission force
Fh horizontal component
Fv vertical component
M engagement position
N nipping part
P paper sheet (sheet)
R ridge

The invention claimed is:

1. An image formation device including: a fixing unit that causes a sheet carrying a toner image to pass through a nipping part formed by bringing a rotary fixing member and a rotary pressure member into pressure contact with each other, so as to fix the toner image to the sheet; and an image formation device body having a fixing unit housing part that the fixing unit is to be removably housed in, an inserting and withdrawing direction of the fixing unit with respect to the fixing unit housing part agreeing with an axial direction of the rotary pressure member, a skeletal frame of the image formation device including columns making a pair that are so arranged as to be adjacent to the fixing unit housing part and spaced apart in the inserting and withdrawing direction of the fixing unit, and lateral beams making a pair that are orthogonally connected to the columns making a pair, respectively, as viewed in the inserting and withdrawing direction and support a bottom face of the fixing unit, the image formation device comprising:

a driven gear integrally-rotatably coupled to a far end portion in the inserting and withdrawing direction of the rotary fixing member or the rotary pressure member of the fixing unit;

a driving gear provided in a far end portion in the inserting and withdrawing direction of the fixing unit housing part and being to engage with the driven gear when the fixing unit is housed in the fixing unit housing part; and a drive source to rotatively drive the driving gear, wherein the driving gear and the driven gear are formed so that, during power transmission, a transmission force transmitted from a tooth flank of the driving gear to a tooth flank of the driven gear in a mutual engagement position has a component so directed as to horizontally press the fixing unit against the columns making a pair, and wherein the fixing unit as housed in the fixing unit housing part is pressed by the transmission force against the columns making a pair, and positioned in a direction orthogonal to the inserting and withdrawing direction.

2. The image formation device according to claim 1, wherein the driving gear and the driven gear are formed so that, during the power transmission, an extension line of the transmission force passes above a crossing position where a vertical plane including faces on a fixing unit housing part side of the columns making a pair and a horizontal plane including upper faces of the lateral beams making a pair cross each other, as viewed in the inserting and withdrawing direction of the fixing unit.

3. The image formation device according to claim 1, wherein the driving gear and the driven gear are formed so that, during the power transmission, an extension line of the transmission force passes a crossing position where a vertical plane including faces on a fixing unit housing part side of the columns making a pair and a horizontal plane including upper faces of the lateral beams making a pair cross each other, as viewed in the inserting and withdrawing direction of the fixing unit.

4. The image formation device according to claim 1, wherein the driving gear and the driven gear are formed so that, during the power transmission, a horizontal component and a perpendicular component of the transmission force are equal to each other.

5. The image formation device according to claim 1, wherein the driving gear and the driven gear perform the power transmission so that, during the power transmission, a horizontal component of the transmission force is larger than a vertical component of the transmission force.

6. The image formation device according to claim 1, wherein a face on a fixing unit housing part side of each of the columns making a pair is so formed as to have two ridges extending in an up and down direction and spaced apart in the inserting and withdrawing direction of the fixing unit, and wherein the fixing unit is so formed as to abut the two ridges provided on each of the columns making a pair when pressed by the transmission force against the columns.

7. The image formation device according to claim 6, wherein, on a face of the fixing unit that is to be pressed against the columns making a pair, abutment seats to abut the columns making a pair, respectively, are protrusively provided, and wherein the abutment seats are each so formed as to be able to abut the two ridges provided on one of the columns making a pair when the fixing unit is pressed against the columns.

* * * * *